US011447332B2

(12) United States Patent
Van Laarhoven

(10) Patent No.: US 11,447,332 B2
(45) Date of Patent: Sep. 20, 2022

(54) ASSEMBLY OF AN INLINER AND A TANK CONTAINER

(71) Applicant: MEGA-INLINER INTERNATIONAL GROUP B.V., Valkenswaard (NL)

(72) Inventor: Sidonius Joseph Victor Marie Van Laarhoven, Valkenswaard (NL)

(73) Assignee: MEGA-INLINER INTERNATIONAL GROUP B.V., Valkenswaard (NL)

( * ) Notice: Subject to any disclaimer, the term of this patent is extended or adjusted under 35 U.S.C. 154(b) by 310 days.

(21) Appl. No.: 16/607,489

(22) PCT Filed: Apr. 24, 2018

(86) PCT No.: PCT/NL2018/050259
§ 371 (c)(1),
(2) Date: Oct. 23, 2019

(87) PCT Pub. No.: WO2018/199747
PCT Pub. Date: Nov. 1, 2018

(65) Prior Publication Data

US 2020/0140190 A1 May 7, 2020

(30) Foreign Application Priority Data

Apr. 24, 2017 (NL) ..... 2018765

(51) Int. Cl.
*B65D 88/06* (2006.01)
*B65D 47/14* (2006.01)
(Continued)

(52) U.S. Cl.
CPC ..... *B65D 88/06* (2013.01); *B65D 47/141* (2013.01); *B65D 88/28* (2013.01); *B65D 90/046* (2013.01);
(Continued)

(58) Field of Classification Search
CPC .... B65D 88/122; B65D 88/124; B65D 88/06; B65D 88/10; B65D 88/1606;
(Continued)

(56) References Cited

U.S. PATENT DOCUMENTS 3,225,953 A * 12/1965 Wolfe ..... B65D 88/06 220/4.12
2014/0263361 A1* 9/2014 Starck ..... B65D 88/128 220/562

FOREIGN PATENT DOCUMENTS

DE 1 134 627 8/1962
EP 0 303 160 2/1989
(Continued)

OTHER PUBLICATIONS

International Search Report for PCT/NL2018/050259 dated Jul. 25, 2018, 5 pages.
(Continued)

*Primary Examiner* — Anthony D Stashick
*Assistant Examiner* — Raven Collins
(74) *Attorney, Agent, or Firm* — Nixon & Vanderhye P.C.

(57) ABSTRACT

The invention relates to an assembly (10) of a tank container (20), an inliner (40) and a connection unit (60) for the transport and/or storage of a liquid. The inliner is present in the tank container and the outlet of the inliner is connected to the drain hole (25) of the tank container. A connection unit is present that secures the connection of both outlets and at the same time provides a liquid tight and an air tight connection with an external unit for the delivery or discharge of the liquid contents.

14 Claims, 7 Drawing Sheets

Figure 1:
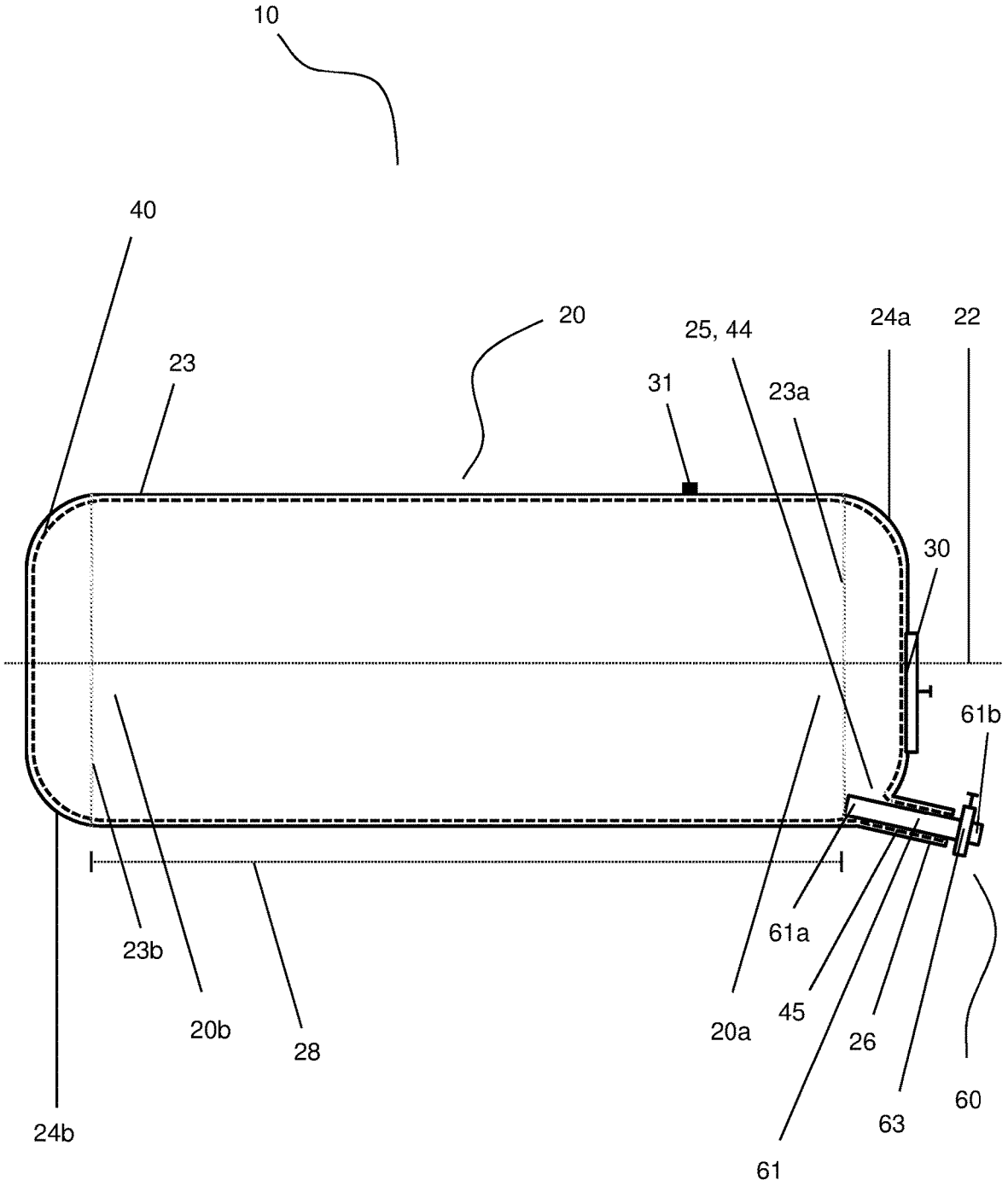

(51) Int. Cl.

| | |
|---|---|
| ***B65D 88/28*** | (2006.01) |
| ***B65D 90/04*** | (2006.01) |
| ***B65D 90/10*** | (2006.01) |
| ***B65D 47/20*** | (2006.01) |

(52) U.S. Cl.
CPC ..... *B65D 90/10* (2013.01); *B65D 47/2018* (2013.01); *B65D 2539/001* (2013.01); *B65D 2590/043* (2013.01)

(58) Field of Classification Search
CPC ..... B65D 88/1618; B65D 88/046; B65D 88/128; B65D 88/28; B65D 2539/001
USPC ..... 220/1.5
See application file for complete search history.

(56) References Cited

FOREIGN PATENT DOCUMENTS

| | | |
|---|---|---|
| EP | 1 557 377 | 7/2005 |
| EP | 1719 714 | 11/2006 |
| JP | 10-287389 | 10/1998 |

OTHER PUBLICATIONS

Written Opinion of the ISA for PCT/NL2018/050259 dated Jul. 25, 2018, 8 pages.

* cited by examiner

ASSEMBLY OF AN INLINER AND A TANK CONTAINER

This application is the U.S. national phase of International Application No. PCT/NL2018/050259 filed Apr. 24, 2018 which designated the U.S. and claims priority to NL Patent Application No. 2018765 filed Apr. 24, 2017, the entire contents of each of which are hereby incorporated by reference.

The invention relates to an assembly of an inliner and a tank container, to an inliner, to a method for folding the inliner, to a method for preparing the assembly and to a method for filling such assembly.

For the transportation and preservation/storage of liquid products, it is common practice to use containers wherein such liquids temporarily reside, and which have dimensions that allow them to be transported over common (rail) roads and on (container)ships. Such containers are usually filled and emptied via a drain hole that is present at or near their the bottom. Possibly other holes are also present that provide access to the inside of the container, such as a manhole or a venting hole.

To avoid contact of the charged liquid with the inside of the container, an inliner may be used inside the container, so that the container after it has been used does not have to be cleaned a laborious and expensive process that is not environmentally friendly. In addition, an inliner may protect the liquid in the container against contamination, decay and spoilage.

A particular type of container for transporting liquids is a so-called tank container. These containers are among the largest containers for this purpose; their content usually ranges from 5.000 $m^3$ to 50.0000 $m^3$. They have a typical content of about 25.000 $m^3$, and are shaped in a more or less cylindrical form. They have round circumferential walls in the alongside direction so as to provide the strongest construction for withstanding the pressure exerted by the liquid content. For this reason, also the end-walls that close the cylinder-like shape are usually curved. Besides liquids, it is possible to transport powders in a tank container with an inliner.

For tank containers, satisfactory inliners are at present not available. This is for several reasons. For example, the narrow space that is usually available around the outlet of the tank container poses difficulties in the design of an easy and tight connection of an inliner with the tank container, while at the same time leaving enough space for the presence of a valve as well as a connection to a hose for the supply and discharge of liquids. Regulations prescribe that outer dimensions of tank containers are bound to a maximum, e.g. for safety reasons in traffic or for reasons of efficient transport when tank containers need to be handled in a harbor and placed onto a ship. Simply shortening the container itself so that more space is left for a proper connection of a hose is a highly unattractive option, because this goes at the expense of the volume that is available for transport. Thus, this would lead to a reduction of the amount of liquid that can be transported in one container unit.

Another problem is the unfolding of the inliner during the filling of the container. With an incorrect unfolding, empty parts of the inliner may be blocked (e.g. by the mass of liquid pressing on them) so that these parts are not filled. At the same time, the inliner itself may be exposed to high stresses due to an imbalanced loading, which may result in bursting of the inliner.

Yet another problem is that the drain hole of the tank container and the eventual spout thereon still get contaminated with the material charged into the tank container, so that a cleaning of the tank container, at least of a part of it, is still necessary.

Also, the inliner needs to remain septic, which requires that it is closed off from the outside environment. At present, there is no equipment that ensures that all parts where the liquid charge passes remain septic.

Another requirement is that the inliner is manufactured in a straightforward manner, while not giving in to the requirement of leak-tightness and good fitting into the tank container. The sheets that need to be used in tank container are so large that any additional handling adds enormously to the laboriousness of the method of manufacturing of the inliner.

It is therefore an objective of the invention to provide an inliner for tank containers that solves one more of the above problems.

Therefore, the present invention relates to an assembly of a tank container (20), an inliner (40) and a connection unit (60) for the transport and/or storage of a fluid, wherein the tank container (20)

1) is of a cylindrical-like shape and comprises a first end portion (20*a*), a second end portion (20*b*) and a longitudinal axis (22) extending from the first end portion (20*a*) to the second end portion (20*b*);
2) comprises a circumferential wall (23) having an inner surface inside the tank container (20) and an outer surface outside the tank container (20), the circumferential wall (23) being present between a first wall (24*a*) at the first end portion (20*a*) of the tank container (20) and a second wall (24*b*) at the second end portion (20*b*) of the tank container (20), the first wall (24*a*) and the second wall (24*b*) having an inner surface inside the tank container (20) and an outer surface outside the tank container (20);
3) comprises a drain hole (25) that is present either in the first wall (24*a*) thereby abutting the circumferential wall (23), or at the interface of the circumferential wall (23) with the first wall (24*a*), the drain hole (25) merging into a container spout (26) extending from the first wall (24*a*) or at the interface of the two walls, the container spout (26) being provided with fastening means (27) for connecting with the connection unit (60);
4) has an inner circumference around the circumferential wall (23);
5) has a bottom length (28), which is the length of the circumferential wall (23) in the longitudinal direction, measured from a) that point on the interface of the circumferential wall (23) with the first wall (24*a*) that comprises the drain hole (25) to b) the corresponding point at the interface of the circumferential wall (23) with the second wall (24*b*);
6) has a first wall height (29) that is defined as the distance from the drain hole (25) to the opposite interface of the circumferential wall (23) with the first wall (24*a*), measured along the inner surface of the first wall (24*a*); and has a second wall height (29') that is defined as the corresponding distance at the second end portion (21*b*) of the tank container (20), measured along the inner surface of the second wall (24*b*);
7) comprises a manhole (30);

wherein the inliner (40)

1) is present inside the tank container (20);
2) comprises at least two sheets (46) lying on top of each other and that are sealed together at their edges (42), the inliner (40) having a longitudinal dimension (length) (41*a*) between two short edges (42*b*) of the inliner (40), the longitudinal dimension (41*a*) being equal to the bottom length (28) plus 0.4-2.0 times the first wall height (29) plus 0.4-2.0 times the second wall height (29'), when measured over the surface of the inliner (40); and a transverse dimension (width) (41*b*) between two long edges (42*a*) of the inliner (40), the transverse dimension (41*b*) being perpendicular to the longitudinal dimension (41*a*) and being in the range of 0.4-1.0 times the inner circumference around the circumferential wall (23), when measured over the surface of the inliner (40), wherein the inner circumference is the largest circumference that is present between the first wall (24*a*) and the second wall (24*b*), measured over the inner surface of the circumferential wall (23);

3) comprises an opening (44) merging into an inliner spout (45), wherein the opening (44) is positioned on or adjacent to a central line (49) extending along the longitudinal dimension (41*a*) of the inliner (40), wherein the shortest distance between the inliner spout (45) and one of the short edges (41*b*) of the inliner (40) is in the range of 0.1-2.0 times the first wall height (29);

the inliner spout (45) is extending through the drain hole (25) and through at least part of the container spout (26), wherein the inliner spout (45) is attached to the container spout (26);

the inliner (40) is oriented in the tank container (20) in such way that the central line (49) along the longitudinal dimension (41*a*) comprising the inliner spout (45) is aligned with the bottom length (28) of the tank container (20), wherein the short edge (42*b*) of the inliner (40) that is closest to the inliner spout (45) is positioned at the first end portion (20*a*) of the tank container (20);

wherein the connection unit (60)

1) comprises a tube (61) for the passage of a fluid, the tube (61) having a first end portion (61*a*) that extends through the container spout (26) and the inliner spout (45), and a second end portion (61 *b*) that is outside the container spout (26), outside the inliner spout (45) and outside the container (20), the second end portion (61*b*) comprising a closing means (63) to control the passage of fluid through the tube (61);

2) comprises fastening means (64) for connecting to the container spout (26);

3) is fastened to the container spout (26);

wherein the first end portion (61*a*) of the tube (61) is pressed against the inside of the inliner spout (45) so that there is a liquid tight and gas tight connection of the inliner spout (45) with the connection unit (60).

FIG. 1 displays a cross-sectional view in the longitudinal direction of an assembly of the invention.

Figure 2:
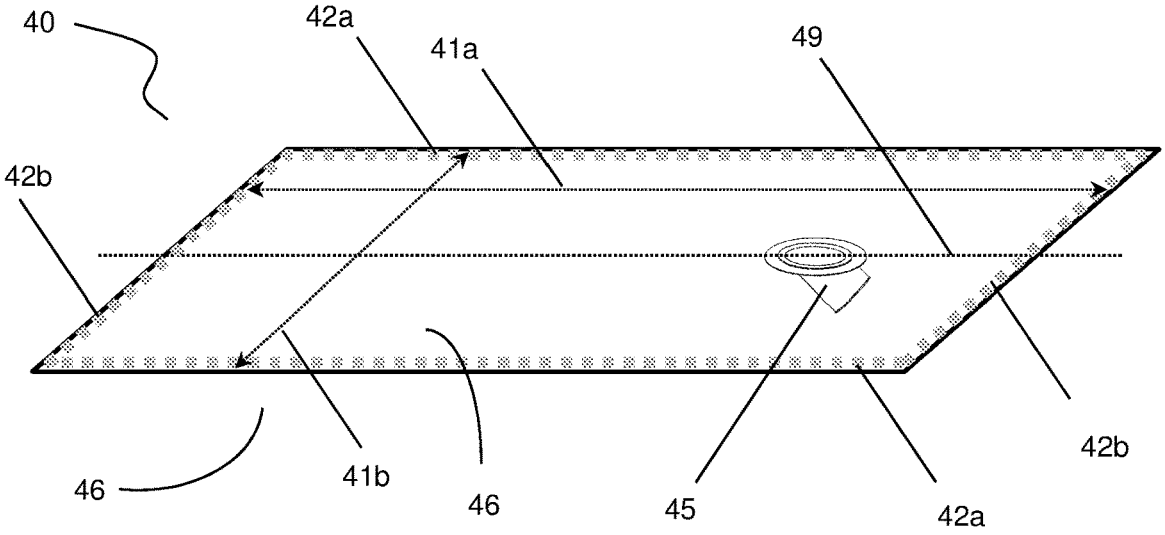

FIG. 2 displays a three-dimensional view of a non-charged inliner of the invention.

Figure 3:
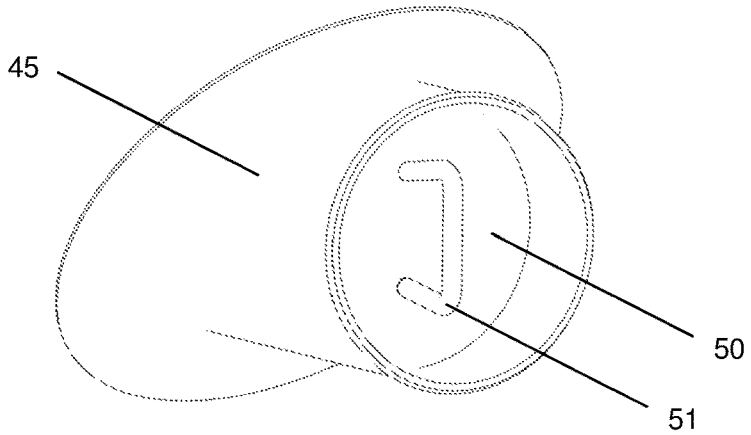

FIG. 3 displays a three-dimensional view of an inliner spout of an inliner of the invention.

Figure 4:
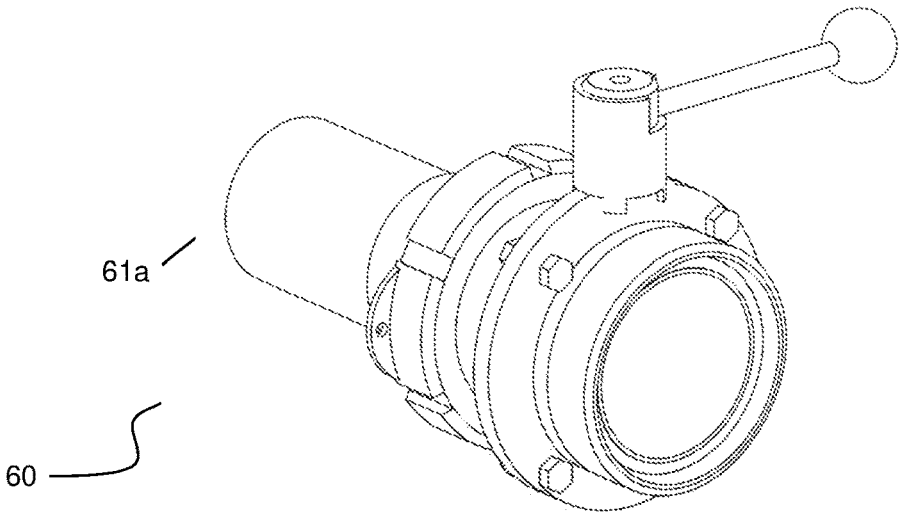

FIG. 4 displays a three-dimensional view of a connection unit of the invention.

Figure 5:
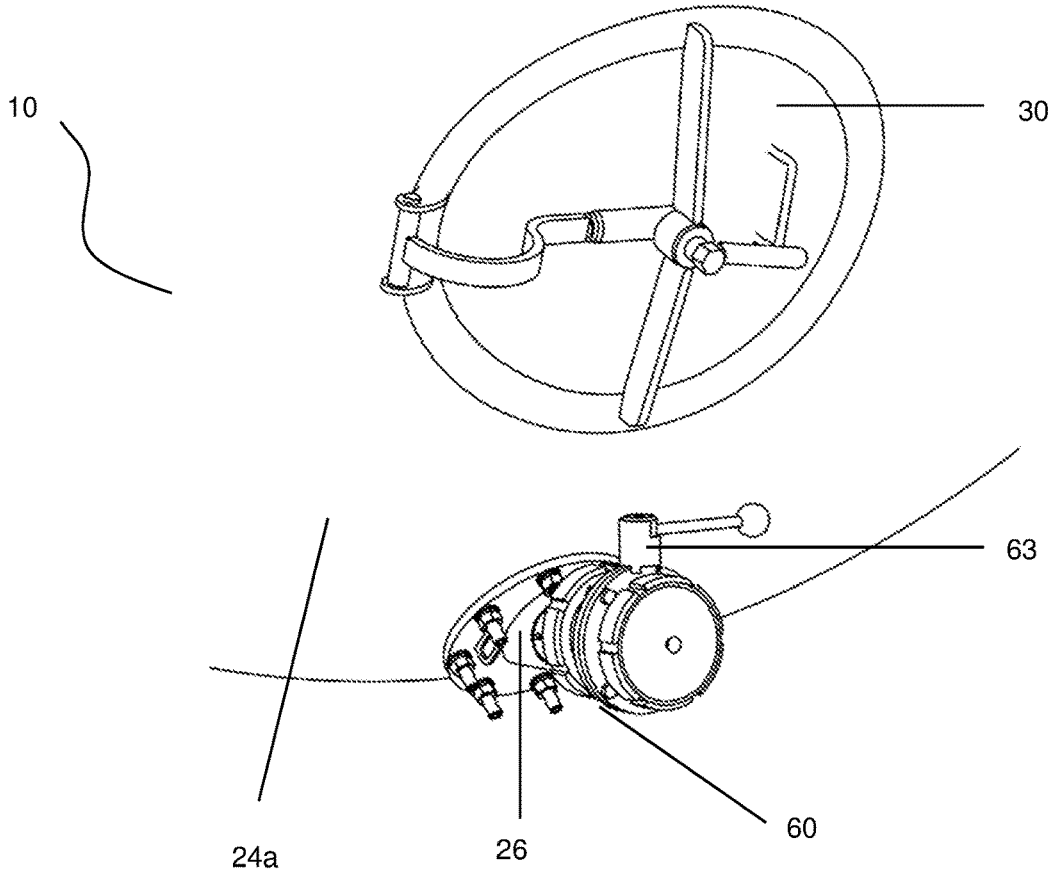

FIG. 5 displays a first three-dimensional view of an assembly of the invention.

Figure 6:
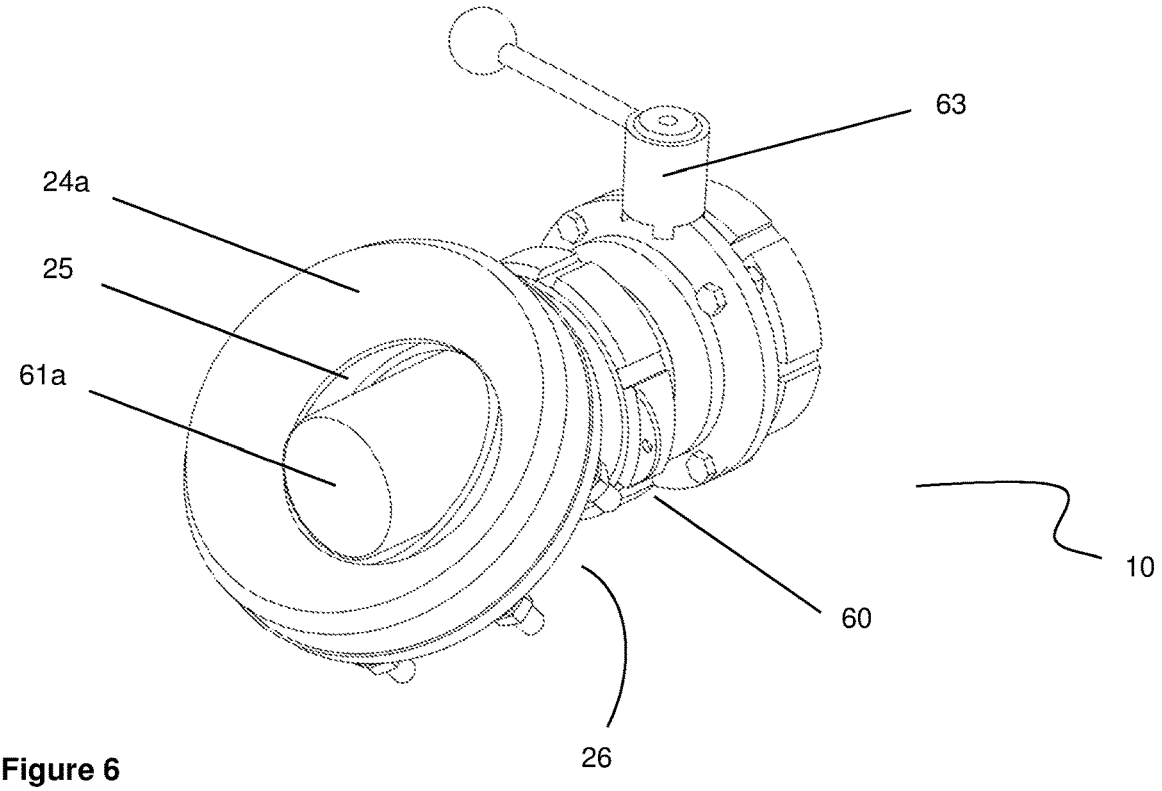

FIG. 6 displays a second three-dimensional view of an assembly of the invention.

Figure 7:
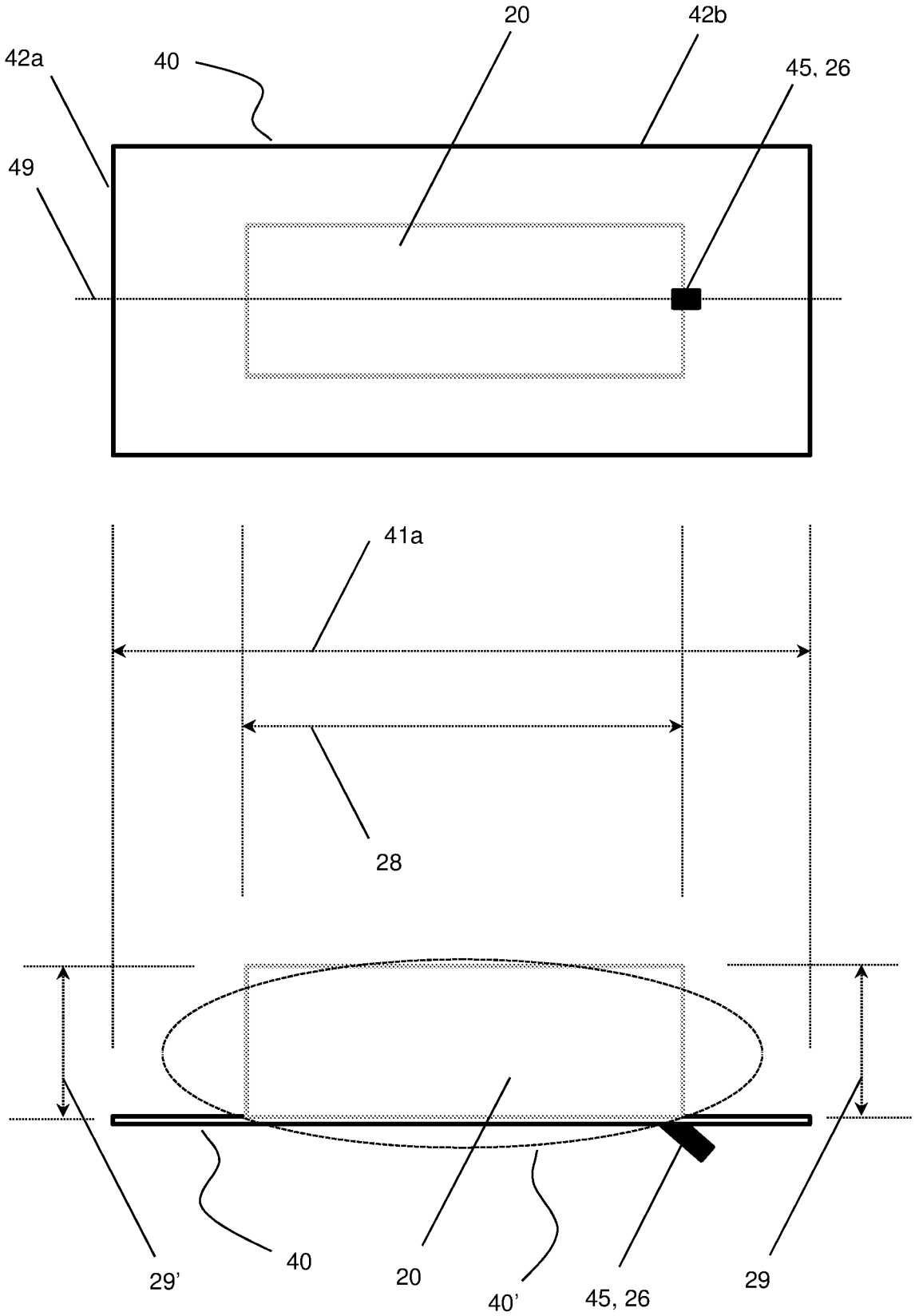

FIG. 7 displays the relative dimensions of the tank container and the inliner of the invention in a top view (upper drawing) and a side view (bottom drawing).

Figure 8:
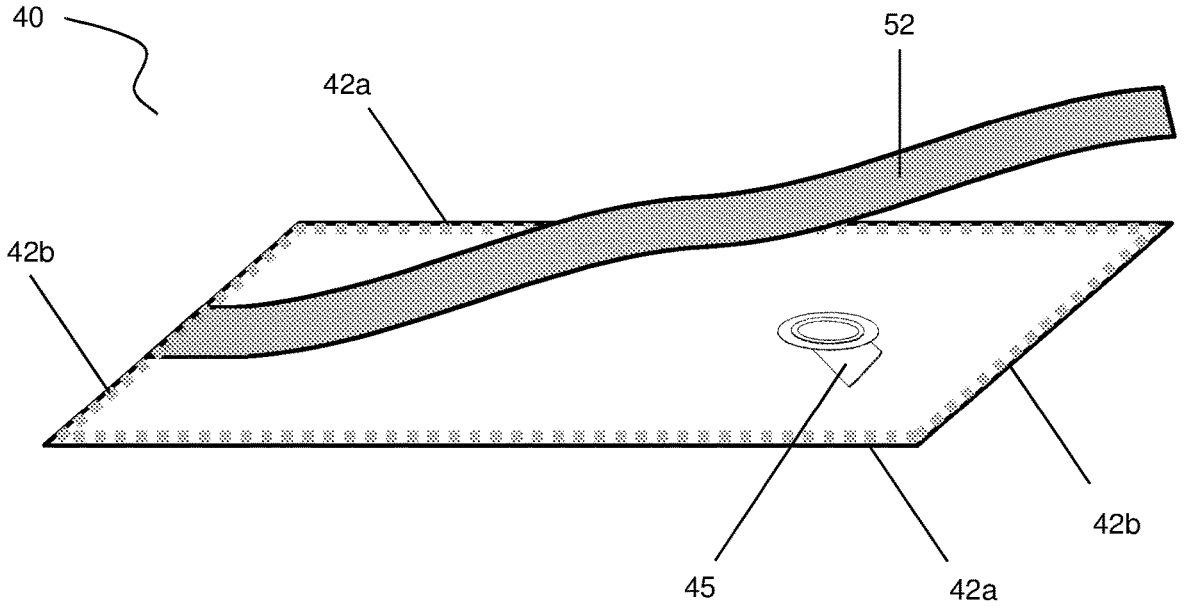

FIG. 8 displays a three-dimensional view of a non-charged inliner of the invention comprising a handle.

Figure 9:
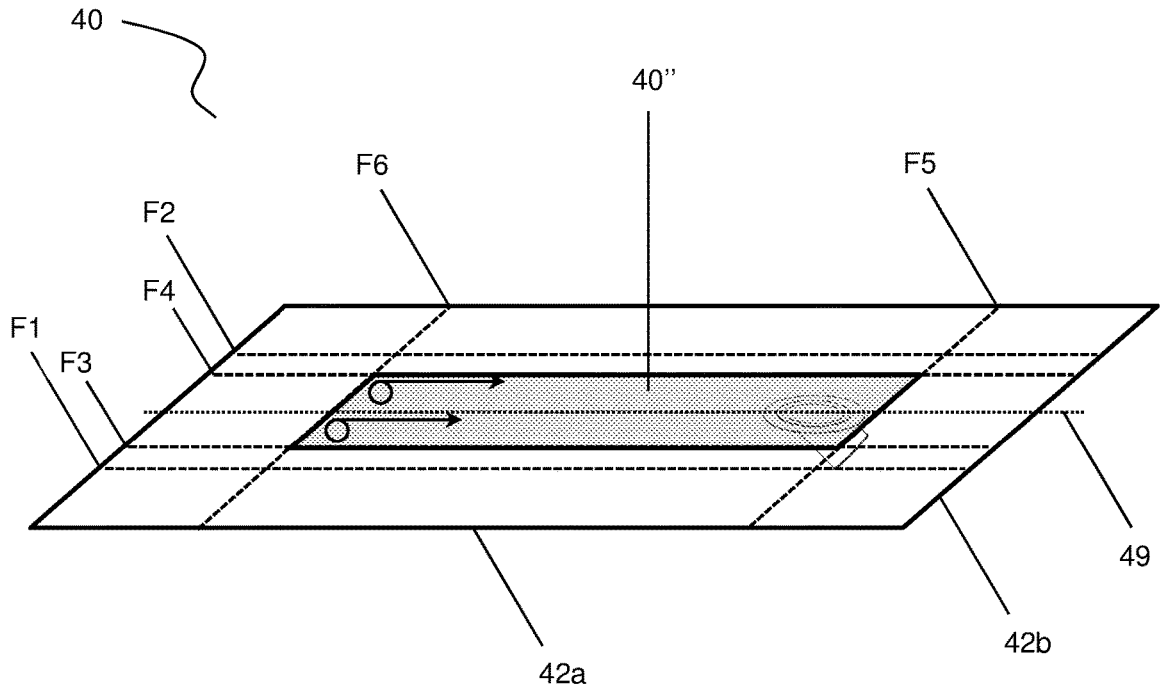

FIG. 9 displays a view of a preferred folding pattern of a non-charged inliner of the invention.

Figure 10:
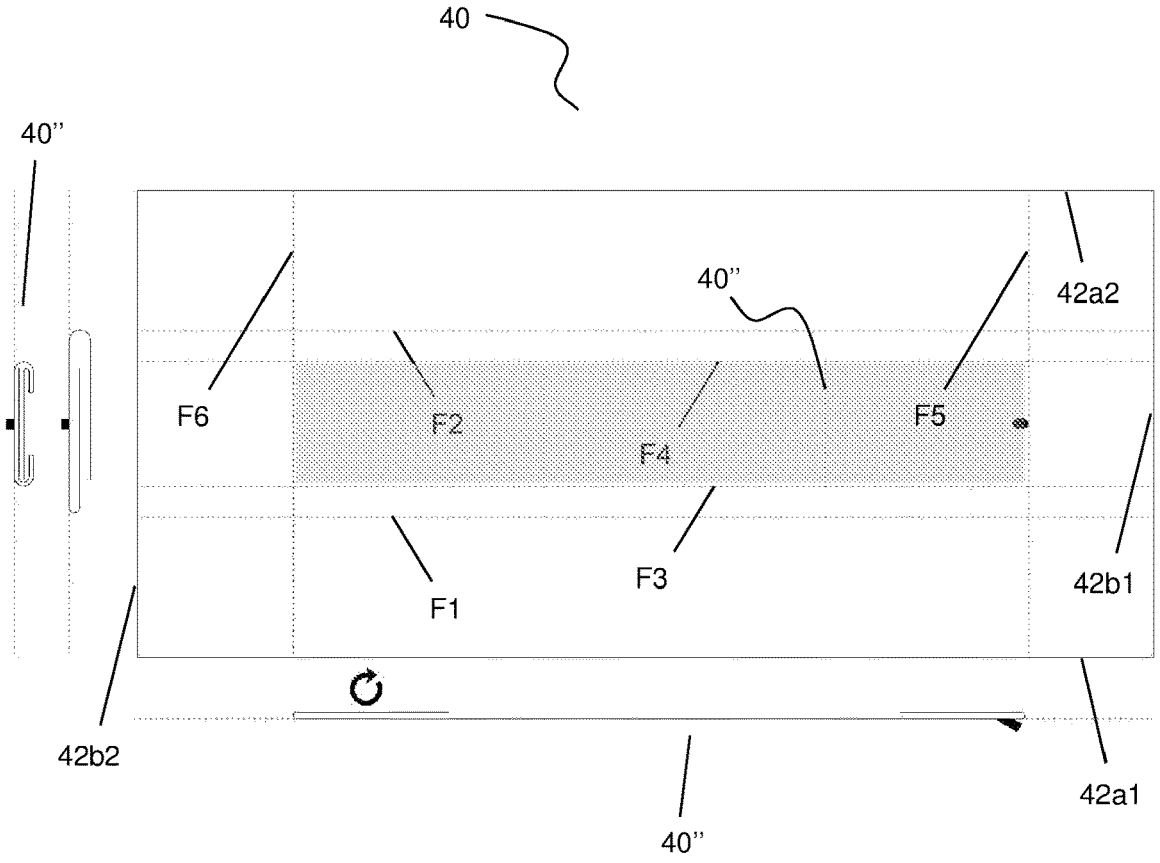

FIG. 10 displays a top-view and two side-views of a preferred folding pattern of a non-charged inliner of the invention.

Figure 11:
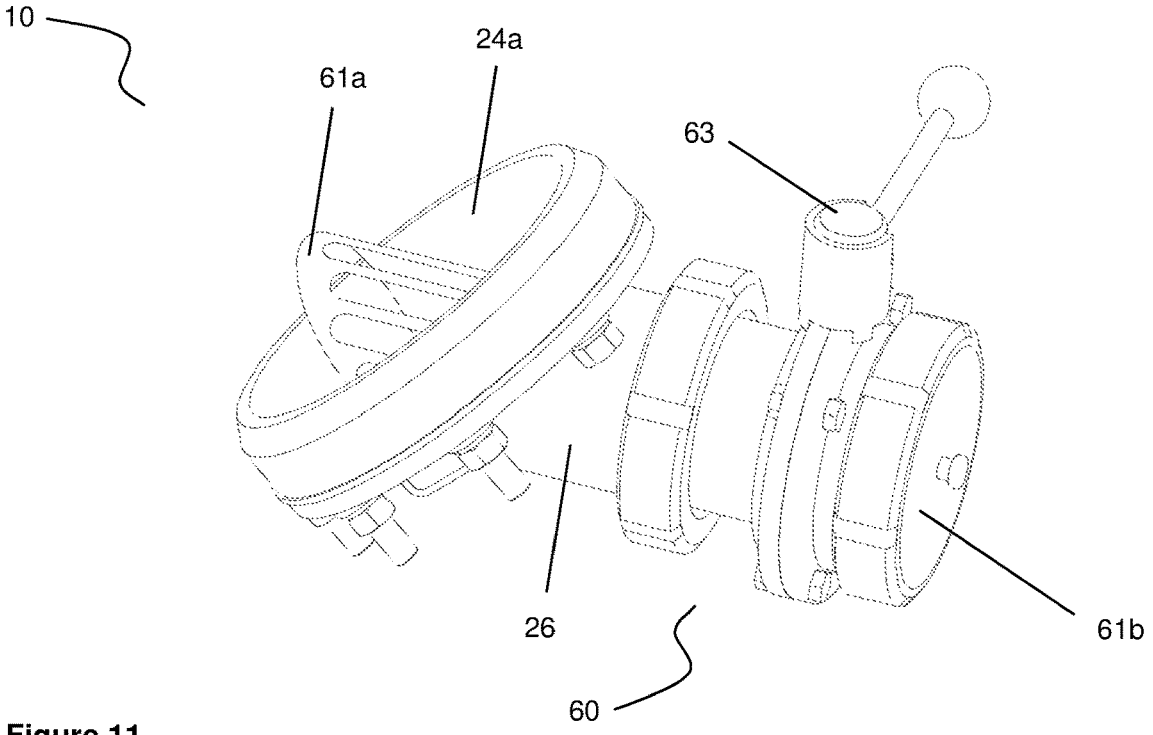

FIG. 11 displays a third three-dimensional view of an assembly of the invention.

Figure 12:
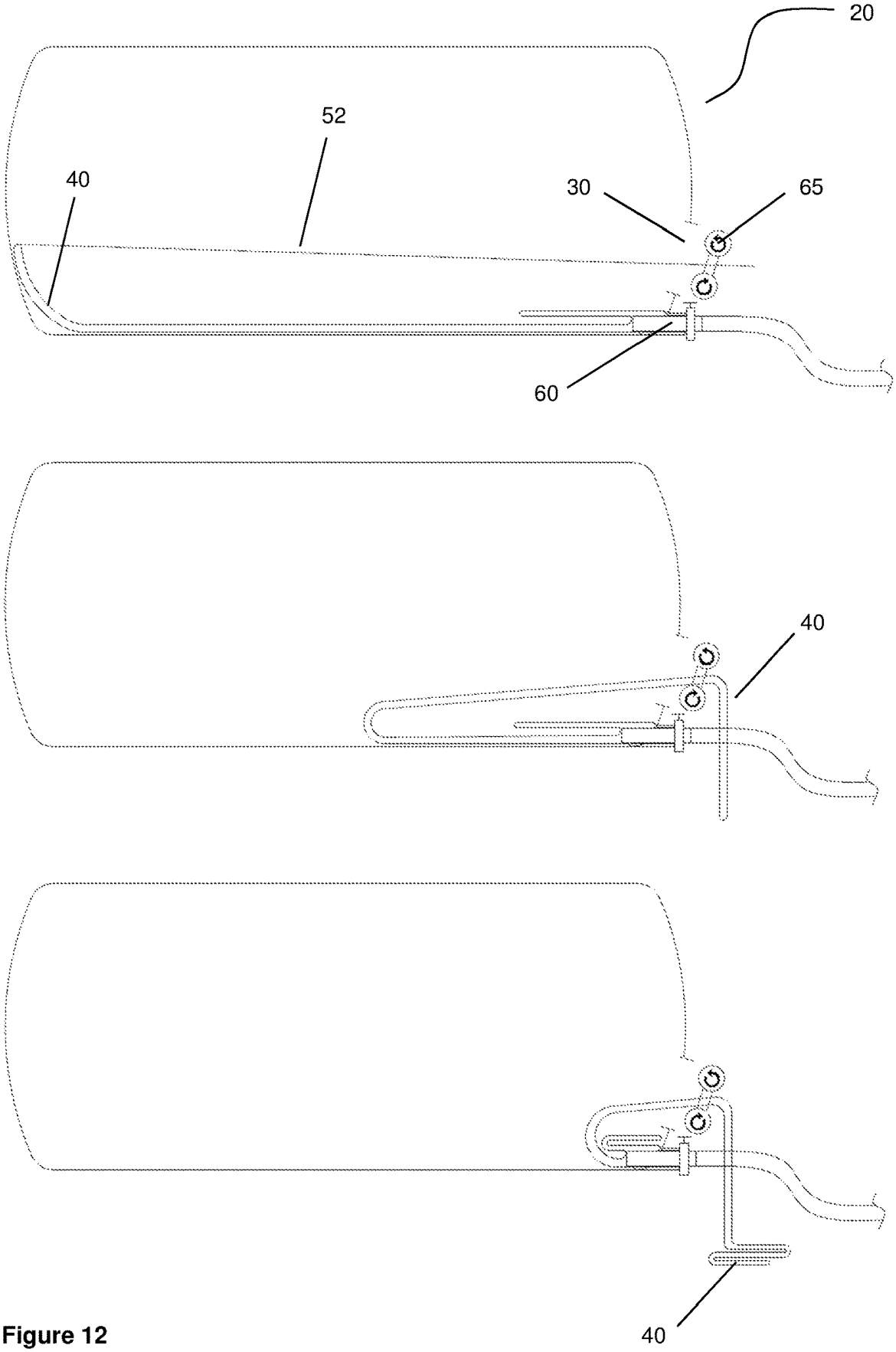

FIG. 12 displays in a series of three cross-sectional views how the inliner may be pulled out of the tank container with the aid of a handle.

Elements in the figures are illustrated for simplicity and clarity and have not necessarily been drawn to scale. For example, the dimensions of some of the elements in the figures may be exaggerated relative to other elements to help improve understanding of various exemplary embodiments of the present invention. Furthermore, the terms "first", "second", and the like herein, if any, are generally used for distinguishing between similar elements and not necessarily for describing a sequential or chronological order.

As illustrated in FIG. 1, an assembly (10) of the invention comprises a tank container (20), an inliner (40) and a connection unit (60).

The tank container (20) comprises a first end portion (20*a*), a second end portion (20*b*) and a longitudinal axis (22) extending from the first end portion (20*a*) to the second end portion (20*b*). A circumferential wall (23) is present between a first wall (24*a*) at the first end portion (20*a*) of the tank container and a second wall (24*b*) at the second end portion (20*b*) of the tank container. In the figure, the two the interfaces of the circumferential wall (23) with the first and second wall (24*a* and 24*b*) are indicated with dotted lines (23*a* and 23*b*). A drain hole (25) is present in the tank container (20), which is located in the first wall (24*a*) next to the circumferential wall (23). The drain hole (25) merges into a container spout (26) that extends from the first wall (24*a*). The tank container (40) has a bottom length (28), which is the distance between the first wall (24*b*) and the second wall (24*b*). Further, a manhole (30) is present in the tank container (20), preferably in the first wall (24*a*). Usually, the tank container (20) also comprises a venting hole (31) for the release of air during the filling of the container.

The inliner (40) is present inside the tank container (20). It comprises an opening (44) merging into an inliner spout (45). The inliner spout (45) is present in the drain hole (25) and the container spout (26) of the tank container (20).

The connection unit (60) comprises a tube (61) for the passage of a liquid. The tube (61) has a first end portion (61*a*) and a second end portion (61*b*). The first end portion (61*a*) is present in the inliner spout (45) which in its turn is present in container spout (26). The second end portion (61*b*) is present outside the container spout (26), outside the inliner spout (45) and outside the container (20). It comprises a closing means (63) to control the passage of liquid through the tube (61).

FIG. 2 is a three-dimensional view of an inliner (40) of the invention, wherein the two sheets (46) are sealed together at their edges (42). The seal is represented by the dotted line around the inliner (40) at the edges (42*a*) and (42*b*). The inliner (40) has a longitudinal dimension (length) (41*a*) between two short edges (42*b*) and a transverse dimension (width) (41*b*) between two long edges (42*a*), wherein the transverse dimension (41*b*) is perpendicular to the longitudinal dimension (41*a*). A central line (49) is defined in the longitudinal dimension (41*a*), which line crosses the two short edges (42*b*) at their middle. On or adjacent to the central line (49) is present the opening (44), which opening merges into the inliner spout (45).

In FIG. 3 is displayed a three-dimensional view of the inliner spout (45). It contains a stopper (50) with a hand grip (51). The hand grip (51) allows the user of the inliner (40) to draw the stopper (50) towards the end of the inliner spout (45) and/or to draw the inliner spout (45) into the container spout (26).

In FIG. 4 is displayed a three-dimensional view of the connection unit (60), comprising the first end portion (61*a*), the second end portion (61*b*) and the closing means (63).

In FIG. 5 is displayed a three-dimensional external view of that part of an assembly (10) of the invention that comprises the container spout (26), the first wall (24*a*), the manhole (30) comprising a lid, and the connection unit (60) comprising the closing means (63).

In FIG. 6 is displayed a three-dimensional internal view of that part of an assembly (10) of the invention that comprises the drain hole (25) in the first wall (24*a*), the container spout (26) that extends from the drain hole (25) and the connection unit (60) that is connected to the container spout (26) and comprising the closing means (63). The first end portion (61*a*) of the connection unit (60) protrudes through the drain hole (25) into the tank container (20).

In FIG. 7 are displayed an inliner (40) of the invention and a tank container (20) of the invention. The inliner (40) is completely unfolded and lies on a flat surface, while the tank container (20) is placed on top of the inliner (40) with the container spout (26) and the inliner spout (45) aligned. The upper drawing in FIG. 7 is a top view and the lower drawing a side view. This Figure demonstrates the shapes and the relative dimensions of the tank container (20) and the inliner (40), such as the longitudinal dimension (length) (41*a*), the bottom length (28), the first wall height (29) and the second wall height (29'). In the lower drawing, the inliner (40') as such is displayed in the state when it would be filled with air in the absence of the tank container (20) (the dotted line with the elliptical shape), giving the inliner (40') a pillow-like shape. This makes clear that when the inliner (40) would be filled with liquid while it resides inside the tank container (20), it may be oversized at some points and is large enough to allow a complete filling of the tank container (20).

FIG. 8 displays a non-charged inliner (40) of the invention comprising a handle (52), highlighted in grey.

FIG. 9 displays a preferred folding pattern of a non-charged inliner (40) of the invention, wherein firstly a folding occurs at the first and second folding lines (F1) and (F2); secondly a folding occurs at the third and fourth folding lines (F3) and (F4); thirdly a folding occurs at the fifth and sixth folding lines (F5) and (F6). This results in the folded inliner (40"), the upper surface of which is highlighted in grey in FIG. 9. This folded inliner (40") may then be rolled up from the sixth folding line (F6) towards the inliner spout (indicated by the arrows in FIG. 9).

FIG. 10 displays such preferred folding pattern in more detail, from three perpendicular viewing directions (top view, left view and front view). All three views display the folded inliner (40"). The top view displays the rectangular shape of the surface of the inliner (40), with the surface of the folded inliner (40") highlighted in grey. The view from the left faces the second short edge (42*b*2) and shows the first two stages of the folding process; the first stage after folding at folding lines (F1) and (F2) and the second stage after folding at folding lines (F3) and (F4). The view from the left after the second stage of folding displays the folded inliner (40"), clearly demonstrating the requirement that the first long edge (42*a*1) and the second long edge (42*a*2) remain at their position during folding at folding lines (F3) and (F4). The view from the front faces the first long edge (42*a*1) and shows the subsequent stage of the folding process, i.e. folding at folding lines (F5) and (F6). This view also displays the folded inliner (40"). Finally, the folded inliner (40") may be rolled up, as indicated by the curved arrow in bold.

FIG. 11 displays an assembly (10) of the invention that is a variation on the assembly shown in FIG. 6. The first end portion (61*a*) of the connection unit (60) has a slanted end that protrudes through the drain hole (25) into the tank container (20), i.e. the end portion (61*a*) may be regarded as having an oblique cut off. In the figure, the oblique cut off faces the bottom of the tank container (20), so that the farthest protrusion is most distant from the bottom of the tank container (20).

FIG. 12 displays in a series of three cross-sectional views how the inliner (40) may be removed from the tank container (20) by pulling it through the manhole (30) with the aid of a handle (52). In the upper view, it is displayed that the handle (52) is connected to the second short edge (42*b*2), which is the edge of the inliner (40) that is most remote from the manhole (30). A pulling mechanism (65) is placed close to the manhole (30) to support the pulling, although this may in principle also be performed manually. By pulling the handle (52), the second short edge (42*b*2) is moved towards the manhole (30). In the middle and bottom view, the progression of pulling the inliner (40) is displayed. In the middle view, the removal of the inliner (40) is approximately halfway. In the bottom view, the inliner (40) has almost completely been removed from the tank container (20). The removal has now arrived at the stage wherein the inliner spout (45) needs to be disconnected from the container spout (26).

The tank container is of a cylindrical-like shape. By cylindrical-like is meant any shape that has a circumferential surface that extends in the longitudinal direction (lengthwise) and is curved in the transverse direction, wherein two (more or less) transverse surfaces are present on either side of the circumferential surface and intersect therewith so that a confined space is formed. For the purpose of the invention, by a circumferential surface is meant a surface that is closed in transverse directions and so forms and endless surface. The circumferential surface is open at both ends, like a section of a pipe. The circumferential surface is not meant to include a surface having sharp edges or corners, such as those in for example a cubic shape.

A cylindrical-like shape is meant to include a true cylindrical shape, which is a shape that has a circular cross-section in the transverse directions (i.e. perpendicular to the longitudinal direction), and which cross-section is substantially the same at any point along the longitudinal direction between the two ends. This means that the circumferential surface extends in the longitudinal direction substantially parallel to the longitudinal direction. Such shape has a longitudinal axis that extends between the two ends of the cylinder along the center of the cylinder.

A cylindrical-like shape may also include any shape that is derived from a cylindrical shape, such as a cylinder that has an oval cross-section at one or more points along the longitudinal direction between the two ends (looking like a cylinder that has been squished to yield a flattened shape). Or it is a cylinder having circular cross-sections in the transverse direction that are of different sizes along the longitudinal direction, which may give the cylindrical-like shape a conical shape.

A tank container of the invention comprises a first end portion and a second end portion, wherein a first wall is present at the first end portion and a second wall is present at the second end portion. The tank container contains a longitudinal axis extending from one end portion to the other end portion of the tank container this is the length of the tank container. Between the first wall and the second wall a circumferential wall is enclosed, which extends in the direction of the longitudinal axis. The first wall, the second wall and the circumferential wall in principle define a confined space. The first wall and the second wall may, independently of each other, be flat or curved. In case the tank container is of a cylindrical shape, the first wall and the second wall are circular.

The tank container has an inner circumference, which is the circumference around the circumferential wall, measured on the inside of the tank container. This inner circumference coincides with the circumference of the cross-sections in the transverse directions as described hereinabove. The inner circumference can be different on different points along the longitudinal axis; in case of a true cylinder, the inner circumference is constant over the length of the container, and in the case of e.g. a conical container, the inner circumference varies over the length.

The inner circumference of the tank container may thus be different from one end to the other. In case it is different, then the inner circumference at the end comprising the drain hole is usually smaller than that at the other end, usually it is not less than 0.9 times the circumference at the other end.

In case the tank container has the shape of a cylinder, then it has a length that is defined as the distance between the first wall and the second wall measured along the longitudinal axis; and a diameter that is defined as the length of the cross-section perpendicular to the longitudinal axis. Usually, the length of such tank container is 1.0-12 times its diameter, preferably, it is 2.0-8.0 times its diameter.

In case the tank container has a shape that is cylindrical-like in that the cross-section of the first and/or the second wall is not circular but with a radially varying diameter, then the length of such tank container is usually 1.0-12 times the diameter of the largest cross-section of any of the first and second wall. preferably 2.0-8.0 times.

In case the tank container has a shape that is cylindrical-like (but not cylindrical), then the diameter of the tank container at the first wall may deviate from the diameter of the tank container at the second wall. Both diameters may differ from each other by a factor of 0.5-1.0, or by a factor of 0.7-1.0. Usually, the length of such tank container is 1.0-12 times the diameter of the tank container at the second wall, preferably, it is 2.0-8.0 times its diameter.

The tank container further comprises a drain hole for the supply and discharge of the liquid contents of the container. The drain hole is located in the first wall very near to the interface of the first wall with the circumferential wall, or at the interface. When it is present at the interface of the circumferential wall with the first wall, then may be present partly in the circumferential wall and partly in the first wall. To the drain hole is connected a spout, which typically is a tube-like structure that extends, at a particular angle, from the container at the location of the drain hole, wherein the drain hole is aligned with the opening of the spout. This spout is named "container spout".

When the tank container is in use, the tank container is preferably oriented such that the drain hole faces the ground; for example, when the tank container is cylindrical and the longitudinal axis is substantially horizontal, then the tank container is oriented such that the drain hole is located at the bottom of the tank container. The container spout, extending at an angle from the tank container (and being outside the container), preferably also faces the ground and/or points to the ground when the tank container is in use. The container spout is provided with fastening means for connecting it to the connection unit. This unit comprises complementary fastening means.

The circumferential wall of the tank container comprises a bottom length, which is the distance between the first wall and the second wall on that part of the circumferential wall that comprises the drain hole or that is abutted by the drain hole. Given the fact that under operational circumstances the drain hole faces the ground, the bottom length of the circumferential wall is at that part of the circumferential wall (and of the tank container) measured in the longitudinal direction of the circumferential wall that faces the ground. The bottom length is therefore the same as the length of the tank container at its bottom. Usually, the bottom of a tank container is straight in the longitudinal direction (substantially uncurved). The bottom length is therefore usually that section of the container's circumferential wall that is straight in the longitudinal direction and that faces the ground.

Both walls of the tank container have a wall height. The wall height of the first wall (i.e. the first wall height (29)) is the distance from the drain hole to the opposite interface of the circumferential wall with the first wall at the first end portion of the tank, measured along the inner surface of the first wall. In case the first wall is not curved but flat, then the wall height of the first wall coincides with the diameter of the tank container at the first wall (as is the case in e.g. FIG. 7). The wall height of the second wall (i.e. the second wall height (29')) is the distance between the two opposite interfaces of the circumferential wall with the second wall at the second end portion of the tank, measured from the end of the bottom length at the second end portion and measured along the inner surface of the second wall. In case the second wall is not curved but flat, then the wall height of the second wall coincides with the diameter of the tank container at the second wall (as is the case in e.g. FIG. 7).

When a tank container is used wherein the first wall and the second wall have the same dimensions (e.g. when the tank container is symmetrical with respect to a symmetry axis perpendicular to the cylinder), then the first wall height (29) equals the second wall height (29'), as is the case in e.g. FIGS. 1 and 7.

In an assembly of the invention, the inliner is present inside the tank container. It has to be brought into the tank container via a hole different from the drain hole. Therefore, the tank container comprises a hole that is large enough for the (folded) inliner to pass through. Usually, such hole is a manhole, e.g. a hole that is large enough for one person to pass through, e.g. a hole with a diameter in the range of 25-50 cm. The hole is usually equipped with a door to close-off the hole. Preferably, the manhole is located in the same wall as the drain hole, in particular the first wall, so that the positioning of the inliner in the tank container is easy to carry out. Usually, the tank container also comprises a venting hole for the release of air during the filling of the container.

The inliner is made from at least two sheets, preferably rectangular sheets, that are sealed together at their ends and so form a closed compartment. When more than two sheets are used in a wall of the inliner, there is less chance on leaking in case there is a puncture in the sheet prior to the sealing. Therefore, preferably, the inliner is made of four (or more) sheets that are sealed together ('bag-in-bag system').

The sheets themselves may be layered and so comprise a plurality of layers that have been glued together before the resulting sheet is sealed to another sheet. Usually, it comprises at least one barrier layer that is substantially impenetrable to air and water. The sheets are preferably of substantially the same shape, so that after sealing a substantially flat inliner is formed i.e. when the inliner is substantially empty, its shape is flat. It is also possible that the inliner is made from a single sheet that is prepared in a hose-like form (having a curcumferential surface), from which only the two open ends have to be sealed together to yield a closed compartment.

In an embodiment, the inliner (40) has a longitudinal dimension (41*a*) in the range of 8-10 meters, preferably in the range of 8.2-9.0 meters, and the transverse dimension (41*b*) is in the range of 4-6 meters, preferably in the range of 4.2-5.0 meters. In such inliner, or in any other inliner of the invention, the distance from the spout to the nearest short edge (42*b*) is in the range of 1.0-1.5 meters.

The inliner (40) preferably comprises a handle (52), for example one that is attached to two different points of the inliner (40), preferably two distant points such as points on opposite edges. It is generally preferred that the handle (52) is present on that side of the inliner (40) that is opposite to the side of the inliner (40) comprising the inliner spout (45).

In a preferred embodiment, the handle (52) is a strip, for example a strip of plastic, in particular made of the same sheet material as that of the inliner (40). One end of such strip may be connected to one of the short edges (42*b*), and the other end of such strip to the other short edge (42*b*), so that the strip is present on the central line (49) and aligned therewith (see FIG. 8). In addition, it is then preferred that the strip is present on that side of the inliner (40) that is opposite to the side comprising the inliner spout (45).

When the handle (52) is a strip that is present on that side of the inliner (40) that is opposite to the side comprising the inliner spout (45), the strip has a first end that is connected to the inliner (40) at the second short edge (42*b*2) that is most remote from the spout (45), or that is connected to the inliner (40) at a distance from that second short edge (42*b*2) that is less than 0.30 times, less than 0.25 times, less than 0.20 times, less than 0.15 times, less than 0.10 times or less than 0.05 times the longitudinal dimension (41*a*). Such strip preferably ends at the other short edge (42*b*1) (i.e. the one that is most near the inliner spout (45)), so that it is within reach for an operator who stands in front of the manhole (30). Therefore, the strip has a second end at a distance from the first end, the distance being at least 0.75 times, at least 0.80 times, at least 0.85 times, at least 0.90 times, at least 0.95 times, at least 1.0 times, at least 1.05 times, at least 1.10 times, at least 1.15 times, at least 1.20 times or at least 1.25 times the longitudinal dimension (41*a*) of the inliner (40), measured over the surface of the strip. Usually, the length of the strip itself is in the range of 0.75-1.3, preferably 0.85-1.15, times the longitudinal dimension (41*a*) of the inliner (40), measured over the surface of the strip.

The second end of the strip may also be connected to the inliner (40). In such cases, the distance between the connection of the first end of the strip and the connection of the second end of the strip is in principle equal to or smaller than the length of the strip. Usually, it is at least 0.90 times the length of the strip.

Preferably, the strip is connected to both short edges (42*b*) of the inliner (one end at one short edge (42*b*2) and the other end at the other short edge (42*b*1)), so that it extends over the entire length of the inliner (40). In such case, the length of the strip is in principle at least as long as the longitudinal dimension (41*a*).

The presence of the handle (52) has multiple functions, which are advantageous when the inliner is applied. First, it protects the actual inliner against the contact with the inner wall of the tank container that faces the strip. When the inliner is filled, the strip is at the highest position in the tank, i.e. most remote from the bottom wherein the drain hole resides. During transport, this part of the inliner is susceptible to movement during accelerations and decelerations, and may so repeatedly touch the inner wall of the tank container. It may then get worn out and become weaker. The handle forms a protective layer that prevents this. A second function of the handle (52) is that it may help in discharging the last traces of the liquid from the tank container. An operator may pull that part of the handle that is connected to the most remote short edge (42*b*2) and so pull the handle (52) together with the inliner through the manhole and out of the tank container. When the most remote short edge (42*b*2) is lifted a little by the first pulling action of the handle and approaches the drain hole during further pulling, the remaining liquid in the inliner is forced to flow out of the inliner and out of the tank container through the drain hole. A third function of the handle (52) is that it aids in removing the inliner out of the tank container. After continued pulling of the handle, finally the most distant connection point of the handle with the inliner will reach the manhole so that the entire inliner can easily be removed from the tank container via the manhole.

The shape of a (flat) inliner is usually a rectangular shape. This means that it has a longitudinal dimension (a long dimension its length) and a transverse dimension (a short dimension its width), which dimensions are perpendicular, or at least substantially perpendicular. The inliner therefore has two long edges (42*a*) and two short edges (42*b*). More specific, the inliner has a first long edge (42*a*1) and a second long edge (42*a*2); and a first short edge (42*b*1) that is more close to the spout and a second short edge (42*b*2) more remote to the spout. The edges may be straight or curved, and the corners of the rectangular shape may be curved.

In an embodiment, the ratio of the longitudinal dimension (41*a*) to the transverse dimension (41*b*) of the inliner is in the range of 1-5, in particular in the range of 1.5-3.0.

The length of an inliner in an assembly of the invention is equal to the bottom length of the tank container plus 0.4-2.0, preferably 0.5-1.0 times the wall height of the first wall of the tank container plus 0.4-2.0, preferably 0.5-1.0, times the wall height of the second wall of the tank container, when measured over the surface of the inliner and measured along the inner surface of the first and second walls. These dimensions ensure that the inliner, when charged with liquid in the inside of the tank container, is large enough to receive the complete support from the walls of the tank container, and is not subjected to unacceptable tensions itself.

Similarly, the width of an inliner in an assembly of the invention is in the range of 0.4-1.0 times the inner circumference around the circumferential wall, preferably 0.5-0.8 times, when measured over the surface of the inliner and measured along the inner surface of the circumferential wall. Preferably, the width is chosen such that it is between 2-20% larger than half of the inner circumference around the circumferential wall. In case the inner circumference is not constant over the entire length of the container, then the inner circumference that is taken for determining the width of an inliner in the assembly is the largest inner circumference between the first wall and the second wall.

The inliner comprises an opening for the supply and discharge of liquid. This opening merges into an inliner spout and is positioned on or adjacent to a central line extending along the longitudinal dimension of the inliner. The inliner and the tank container are connected via their spouts. The inliner spout is extending through the drain hole of the tank container and through at least part of the container spout. The angle of the spout with the central line of the inliner towards the closest short edge of the inliner is usually in the range of 30-75°.

Usually, the outside of the inliner spout has a shape that corresponds to the shape of the inside of the container spout. The inliner spout is then attached to the container spout, for example by means of a ridge on the inliner spout that falls into a corresponding groove of the container spout, or that falls over the end of the container spout. The only part of the inliner that may be outside the container is a part of the inliner spout, that extends through the container spout and protrudes from the container spout. However, this is not necessary as the end of the inliner spout may also be held within the container spout. Usually, the inliner has only one opening.

The drain hole usually faces the ground when the assembly of the invention is in use, which means that the tank container's longitudinal axis is substantially horizontal and that the tank container is rotated such around its longitudinal axis, that the drain hole is closest to the ground (as in FIG. 1). In such orientation, the inliner rests on the bottom of the container's inner circumferential surface.

The inliner is preferably oriented in the tank container in such way that the central line along the longitudinal dimension comprising the inliner spout is aligned with the bottom length of the tank container.

As can be seen in FIG. 7, the longitudinal and transversal dimensions exceed those of the tank container, so that the inliner has to be folded and/or rolled up in some manner before it can practically be brought into the inside of the tank container. The inliner may therefore be folded in the following way (FIG. 9).

A first folding structure comprising two folding lines is present wherein the first long edge (42*a*1) and the second long edge (42*a*2) of the inliner (40) are each folded over the central line (49) (i.e. they pass that line) and at the side of the inliner that is opposite to the side containing the inliner spout (45), so that a first folding line (F1) and a second folding line (F2) are present substantially parallel to the central line (49), each folding line (F1) and (F2) occurring at a distance from the central line (49) that is between 0.17 and 0.25, preferably between 0.17 and 0.20, times the length of the short edge (42*b*), and each folding line (F1) and (F2) acting as a new long edge of the inliner having the first folding structure;

A second folding structure comprising two folding lines is present wherein the first folding line (F1) and the second folding line (F2) of the inliner (40) having the first folding structure are each folded without passing the central line (49) and at the side of the inliner (40) that is opposite to the side containing the inliner spout (45), so that a third folding line (F3) and a fourth folding line (F4) are present substantially parallel to the central line (49), wherein the third folding line (F3) is present between the second long edge (42*a*2) and the first folding line (F1) and the fourth folding line (F4) is present between the first long edge (42*a*1) and the second folding line (F2);

A third folding structure is present comprising two folding lines wherein the first short edge (42*b*1) and the second short edge (42*b*2) of the inliner (40) having the first and second folding structure are folded towards each other and at the side of the inliner (40) that is opposite to the side containing the inliner spout (45), so that a fifth folding line (F5) and a sixth folding line (F6) are present substantially perpendicular to the central line (49), wherein the fifth folding line (F5) abuts the inliner spout (45) or is at a distance from the inliner spout (45) of less than one fifth of the smallest distance between the inliner spout (45) and the first short edge (42*b*1) and wherein the sixth folding line (F6) is closer to the second short edge (42*b*2) than to the inliner spout (45).

Optionally, the inliner (40) having the first, second and third folding structure is rolled up from the sixth folding line (F6) towards the inliner spout (45) in that the rolled-up portion is at the side of the inliner (40) that is opposite to the side containing the inliner spout (45).

Thus, the third folding line (F3) is present between the first folding line (F1) and the second long edge (42*a*2); and the fourth folding line (F4) is present between the second folding line (F2) and the first long edge (42*a*1). In this way, none of both long edges (42*a*) are displaced during folding over the third folding line (F3) and the fourth folding line (F4). This, in turn, reduces the number of layers that is stacked after folding over the third folding line (F3) and the fourth folding line (F4). This provides a smoother unfolding of the inliner during the filling, with a reduced chance on the build-up of tensions in the inliner. This way of folding is in particular advantageous at high inliner widths, for example when the short edge (42*b*) is longer than 3.0 m, longer than 3.20 m or longer than 3.45 m.

Accordingly, the invention further relates to a method for folding the inliner, comprising folding the first long edge (42*a*1) of the inliner (40) over the central line (49) (i.e. it passes that line) and at the side of the inliner that is opposite to the side containing the inliner spout (45), so that a first folding line (F1) is formed substantially parallel to the central line (49), the first folding line (F1) occurring at a distance from the central line (49) that is between 0.17 and 0.25, preferably between 0.17 and 0.20, times the length of the short edge (42*b*), the first folding line (F1) acting as a new long edge of the inliner; thereafter folding the second long edge (42*a*2) of the inliner (40) over the central line (49) (i.e. it passes that line) and at the side of the inliner that is opposite to the side containing the inliner spout (45), so that a second folding line (F2) is formed substantially parallel to the central line (49), the second folding line (F2) occurring at a distance from the central line (49) that is between 0.17 and 0.20, preferably between 0.17 and 0.20, times the length of the short edge (42*b*), the second folding line (F2) acting as a new long edge of the inliner; thereafter folding the first folding line (F1) of the inliner (40) without passing the central line (49) and at the side of the inliner (40) that is opposite to the side containing the inliner spout (45), so that a third folding line (F3) is formed substantially parallel to the central line (49), wherein the third folding line (F3) is present between the second long edge (42*a*2) and the first folding line (F1); thereafter folding the second folding line (F2) of the inliner (40) without passing the central line (49) and at the side of the inliner (40) that is opposite to the side containing the inliner spout (45), so that a fourth folding line (F4) is formed substantially parallel to the central line (49), wherein the fourth folding line (F4) is present between the first long edge (42*a*1) and the second folding line (F2); thereafter folding the first short edge (42*b*1) towards the second short edge (42*b*2) of the inliner (40) and at the side of the inliner (40) that is opposite to the side containing the inliner spout (45), so that a fifth folding line (F5) is formed substantially perpendicular to the central line (49), wherein the fifth folding line (F5) abuts the inliner spout (45) or is at a distance from the inliner spout (45) of less than one fifth of the smallest distance between the inliner spout (45) and the first short edge (42*b*1); thereafter folding the second short edge (42*b*2) towards the first short edge (42*b*1) of the inliner (40) and at the side of the inliner (40) that is opposite to the side containing the inliner spout (45), so that a sixth folding line (F6) is formed substantially perpendicular to the central line (49), wherein the sixth folding line (F6) is closer to the second short edge (42*b*2) than to the inliner spout (45); thereafter optionally rolling up the inliner (40) from the sixth folding line (F6) towards the inliner spout (45), wherein the rolled-up portion is at the side of the inliner (40) that is opposite to the side containing the inliner spout (45).

Of course, it is understood that the order of creating the first folding line (F1) and the second folding line (F2) is arbitrarily; as is the order of creating the third folding line (F3) and the fourth folding line (F4); and as is the order of creating the fifth folding line (F5) and the sixth folding line (F6). It is necessary, however, that first folding line (F1) and the second folding line (F2) are created before the third folding line (F3) and the fourth folding line (F4) are created; and that the third folding line (F3) and the fourth folding line (F4) are created before the fifth folding line (F5) and the sixth folding line (F6) are created.

The invention further relates to a folded inliner obtainable by the above folding method.

The opening comprising the inliner spout is preferably located at a substantial distance from the short edges of the inliner. With such distances, the short edges are not present near the interface of the bottom length with either of the walls of the tank container. For example, the short edge is present at least halfway the bottom length and the center of the first wall. This is advantageous for the unfolding of the inliner during the filling of the inliner in the tank container and prevents undesirably high forces on the inliner sheets and the seals. For example, the shortest distance between the inliner spout and one of the short edges of the inliner is in the range of 0.1-2.0 times the wall height of the first wall, measured along its inner surface, preferably in the range of 0.2-1.0, more preferably in the range of 0.4-0.8.

Thus, the inliner has three measures that are related to the dimensions of the tank container; 1) its length; 2) its width; and 3) the position of the spout (in particular the shortest distance from the spout to the closest short edge).

The connection unit has multiple functions. First, it is capable of being fastened to the container spout whilst generating a connection with the inliner spout so that it is in fluid connection with the inside of the inliner. Second, it is capable of shutting off the container spout (and thus the entire container) from the environment by acting as a stopper on the container spout, and/or capable of controlling the passage of liquid through the connection unit. To this end, the unit may comprise a valve. Third, it strengthens the connection between the inliner spout and the container spout, so that the inliner spout cannot be displaced during filling, emptying, storing or transporting the tank container. Fourth, it is capable of connecting to an external unit such as a supply system or a discharge system, for example via a hose or tube. In this way, the inside of the inliner is capable of being in fluid communication with an external supply/discharge system. With a valve in the connection unit, the fluid communication can be blocked or unblocked on purpose. A fifth function of the connection unit is that it pushes against a removable cap that is initially present in the inliner spout. This will be further elaborated below in the method of the invention.

The connection unit comprises fastening means for connecting to the container spout. Therefore, the container spout comprises fastening means that are complementary to that of the connection unit. Preferably, the connection unit also comprises fastening means for connecting to an external supply/discharge system, in particular to a hose or tube that is part of such system.

The connection unit is basically a tube that can guide the flow of liquid from (or into) the tank container, having a first end portion that connects to the tank container and a second end portion that connects to an external unit that can supply or receive the liquid. The tube may be closed by a closing means that is present at the second end portion. This may be a valve or cap to adjust or completely block the flow of liquid to or from the tank container.

When the connection unit is connected to the container spout, then the first end portion of the tube is present in the inliner spout and in the container spout. It may even extend through the inliner spout and pass the drain hole, so that the end is present in the inliner and in the tank container. In this way, With the fastening of the connection to with the container spout, the attachment of the inliner spout to the container spout is tightened due to the pressing of the first end portion of the tube against the inside of the inliner spout. This is an outward force that is exerted by the first end portion of the tube. A second result of this force is that a very tight connection between the inliner spout and the first end portion of the tube is realized. For an improved air- and/or liquid-tightness of the connection, the first end portion of the connection unit and/or the inliner spout may of a conical shape.

With the connection unit in place, a liquid flow does only contact the tube of the connection unit and the inliner spout. The container spout just at the rest of the tank container does not come into contact with the liquid that passes the connection unit during filling or emptying the tank container.

The assembly of the invention comprises three components that are connected to one another. The tank container is connected with the inliner by attaching the container spout to the inliner spout when the inliner spout is enclosed by the container spout. The connection unit is connected to the container spout by complementary fastening means on each entity. At the same time, the first end of the connection unit presses against the spout's inner wall, yielding an outward force so that there is a direct connection between the inliner spout and the connection unit. Any liquid charge that enters of leaves the tank container does not need to come into contact with any part of the tank container, neither with its the inner surface, neither with the container spout. So, the entire tank container itself is not contacted by the liquid charge. After use, the connection unit can be disconnected and the inliner can be removed via the (man)hole, so that the tank container can be re-used without an intermediate cleaning session.

Preferably, the first end portion of the connection unit slides so far through the inliner spout, that it passes through the opening in the inliner and protrudes through the drain hole into the tank container. In such case, in the assembly, the first end portion of the connection unit extends through the inliner spout and protrudes into the tank container and into the inliner, for example at least 4 cm, at least 6 cm or at least 10 cm into the inliner. This has the advantage that the drain hole is not easily susceptible to blocking by the inliner itself when the inliner e.g. collapses during emptying and allows a lap of the inliner to position in front of the drain hole due to the suction of the fluid. To allow a proper flow of liquid, the first end portion may be equipped with openings or recesses along its length (on the circumferential surface of the tube). In this way, any liquid that cannot pass through the main opening of the tube, can at least pass from the sides. For example, the first end portion protrudes at least 4 cm, at least 8 cm or at least 15 cm into the tank container.

In a particular assembly, 1) the tank container is a cylinder (i.e. it has an inner diameter that is substantially constant over its entire length) having an inner diameter in the range of 2.2-2.5 meters and a bottom length in the range of 5.5-6.5 meters, in particular in the range of 5.9-6.1 meters; and 2) the inliner is of a rectangular shape with a longitudinal dimension (41*a*) in the range of 8-10 meters, preferably in the range of 8.2-9.0 meters, and a transverse dimension (41*b*) in the range of 4-6 meters, preferably in the range of 4.2-5.0 meters, the inliner further having a distance from the spout to the nearest short edge (42*b*) that is in the range of 1.0-1.5 meters.

The invention further relates to an inliner (40) for use in an assembly of the invention, the inliner (40) comprising at least two, preferably four, sheets (46) lying on top of each other and being sealed together at their edges (42), the inliner (40) comprising

- a longitudinal dimension (length) (41*a*) between two short edges (42*b*) of the inliner (40);
- a transverse dimension (width) (41 *b*) between two long edges (42*a*) of the inliner (40), the transverse dimension (41 *b*) being perpendicular to the longitudinal dimension (41*a*),
- an opening (44) merging into an inliner spout (45), wherein the opening (44) is positioned on or adjacent to a central line (49) extending along the longitudinal dimension (41*a*) of the inliner (40).

The inliner spout (45) is preferably provided with a stopper (50) that closes the inliner spout (45), which stopper (50) is capable of being released into the inliner (40) when the inliner (40) is positioned in the assembly (10) of the invention. Such stopper (50) keeps the inside of the inliner (40) separated from the environment, so that contamination of the inliner (40) prior to its filling in the assembly (10) is prevented.

The invention further relates to a method for preparing an assembly of the invention, the method comprising

- providing a tank container (20) as described hereinabove;
- providing an inliner (40) as described hereinabove, wherein
  1) its longitudinal dimension (41*a*) is equal to the bottom length (28) of the tank container (20) plus 0.4-2.0 times the first wall height (29) plus 0.4-2.0 times the second wall height (29'), when measured over the surface of the inliner (40); and
  2) its transverse dimension (41*b*) is in the range of 0.4-1.0 times the inner circumference around the circumferential wall (23), when measured over the surface of the inliner (40), wherein the inner circumference is the largest circumference that is present between the first wall (24*a*) and the second wall (24*b*), measured over the inner surface of the circumferential wall (23); and
  3) the shortest distance between the inliner spout (45) and one of the short edges (41*b*) of the inliner (40) is in the range of 0.1-2.0 times the wall height of the first wall (24*a*);
- providing a connection unit (60) as described hereinabove;
- bringing the inliner (40) into the inside of the tank container (20) by passing it through the manhole (30);
- pressing the inliner spout (45) into the container spout (26) and aligning the inliner (40) with the tank container (20) so that the central line (49) of the inliner (40) is substantially in the direction of the bottom length (28);
- pushing the first end portion (61*a*) of the tube (61) of the connection unit (60) into the container spout (26) and the inliner spout (45) from the outside of the tank container (20); and in the event that the inliner (40) is blocked with a stopper (50), pushing the stopper (50) backwards into the inliner (40); and
- fastening the connection unit (60) to the container spout (26), by connecting fastening means (27) with fastening means (64).

In case the inliner is provided with a stopper, by pushing the first end portion (61*a*) of the tube (61) of the connection unit (60) into the container spout (26) and the inliner spout (45) from the outside of the tank container (20), the stopper that blocks the inliner spout is pushed backwards into the inliner. In this way, the stopper releases from the inliner spout (45) and so opens the inliner spout so that the passage of fluid through the inliner spout become possible. When at the same time (or very shortly thereafter) the container spout (26) is connected to the connection unit by the fastening means (27) and (64), a tight connection between the inliner spout and the first end portion (61*a*) of the tube (61) is realized. The advantage of this procedure is that any contamination of the parts of the assembly (10) that come into contact with the fluid to be charged into the inliner, is maximally reduced. In addition, when connected, any fluid entering or exiting the tank container, passes through the drain hole (25) of the tank container without being in contact with any part of the tank container, such as its inner walls and the container spout (26).

It is preferred in a method of the invention that the first end portion (61*a*) is pushed so far through the inliner spout (45) that it appears at the side of the inliner spout (45) that is opposite to the side of entering the inliner spout (45). This means that the first end portion (61*a*) is situated in the inliner (40). In fact, this also means that it is situated in the tank container (20), because the opening (44) (which is at the junction of the inliner spout (45) and the inliner (40)) is present inside the tank container (20), adjacent to the drain hole (25) (which is at the junction of the container spout (26) and the tank container (20)). Thus, in such method, the first end portion (61*a*) is pushed into the container spout (26) and the inliner spout (45), until it extends through the container spout (26) and through the inliner spout (45) into the tank container (20) and into the inliner (40).

The first end portion (61*a*) does not necessarily protrude at its entire circumference into the tank container (20). For example, it is possible that some parts of the circumference are still situated inside the inliner spout (45) or coincide with the opening (44). In other words, in such situation, the first end portion (61*a*) does not protrude through the inliner spout (26) into the inliner (40) at the entire circumference of the opening (44). This may be the case when the first end portion (61*a*) of the connection unit (60) has a slanted end that protrudes through the drain hole (25) into the tank container (20), i.e. the end may be regarded as having an oblique cut off.

When this is the case, then it is preferred that the part of the first end portion (61*a*) that has the smallest extension into the tank (or no extension at all) is closest to the bottom length (28) (i.e. is closest to the bottom of the container).

In other words, the part of the first end portion (61*a*) near the bottom length (28) then has a smaller extension into the inliner (40) than the opposite part of the first end portion (61*a*) that is further away from the bottom length (28). When this is the case, then this has the advantage that there is a minimized chance on puncturing of the inliner by the first end portion (61*a*) when the connection unit (60) is put into place, while at the same time the drain hole is prevented from becoming blocked by the inliner itself (the latter may occur in an unfortunate situation when the inliner collapses during emptying and a part of the inliner ends up in front of the drain hole due to the suction of the fluid).

When the end portion (61*a*) protrudes into the inliner (40), this is preferably at least 4 cm. It may also be at least 10 cm, at least 15 cm, at least 20 cm, at least 25 cm, at least 30 cm or at least 40 cm.

Preferably, the inliner that is provided in a method of the invention is folded. More preferably, it is folded according to the folding pattern as elaborated hereinabove.

The invention further relates to a method for filling an assembly of the invention with a fluid, in particular a liquid, from an external unit, the method comprising connecting the external unit to the connection unit (60) of the assembly (10), preferably with a hose, followed by creating a flow of the fluid from the external unit via the hose into the assembly (10).

During or after the connecting of the external unit to the connection unit, a fluid communication between both parts has to be realized. For example, in case a valve is present on the connection unit, then the valve needs to be opened prior to filling the tank container with the liquid.

In the filling method of the invention, it is preferred that the inliner is folded (i.e. it is in a folded state) when the filling of the assembly starts. Possibly, it is also rolled up as indicated in FIGS. 9 and 10. When the amount of liquid in the tank container increases, the inliner will unfold (and if it is initially also rolled up unroll) by itself. The presence of the inliner in a folded state prior to the filling is advantageous for the filling, since the filling then occurs more smoothly and without the generation of stresses in the inliner sheets and the seals, which may cause bursting of the inliner. Moreover, in this way empty parts do not get blocked by e.g. the mass of other parts of the inliner that are already filled, which mass may press on them and so prevent them from being filled (self-blocking). With the specific folding pattern of the inliner as described hereinabove, the unfolding and the filling occurs particularly advantageous, with a minimal chance on bursting of the inliner and on self-blocking.

In a particular method, 1) the tank container is a cylinder (i.e. it has an inner diameter that is substantially constant over its entire length) having an inner diameter in the range of 2.2-2.5 meters and a bottom length in the range of 5.5-6.5 meters, in particular in the range of 5.9-6.1 meters; and 2) the inliner is of a rectangular shape with a longitudinal dimension (41*a*) in the range of 8-10 meters, preferably in the range of 8.2-9.0 meters, and a transverse dimension (41*b*) in the range of 4-6 meters, preferably in the range of 4.2-5.0 meters, the inliner further having a distance from the spout to the nearest short edge (42*b*) that is in the range of 1.0-1.5 meters.

It is an advantage of an assembly of the invention that the use of the connection unit provides a simple and reliable means for creating a leak tight connection between the inliner in the container and an external unit that provides or receives the fluid charge of the tank container. Moreover, such fluid does not come into contact with the tank container or any accessory of the container such as the container spout. The connection unit that is contacted with the fluid is easily removable from the tank container and can be cleaned as such, if desired.

An additional advantage of an assembly of the invention is that the liquid in the container does not come into contact with any air that is present in the tank container when empty. Prior to the filling, the inliner is empty and in principle does not contain any air. During the filling, the volume of the inliner increases and expels the gas (usually air) that is present in the tank container before charging the tank container. This gas usually leaves the tank container via a venting hole. This non-atmospheric filling prevents deterioration of the liquid charge, which may occurs by oxidation.

An additional advantage of the non-atmospheric filling is that foam formation during filling of the container (the inliner) can be suppressed by applying a counterpressure in the tank container to the inliner, especially when the liquid comprises dissolved carbon dioxide such as in beer. The application of a counter pressure in the absence of an inliner is conventionally performed by an inert gas such as carbon dioxide or nitrogen, or by a specifically designed mixture of specific gases. However, when the inliner is present in the tank container, this may be performed by any available gas. This may also be air, which is environmentally friendly to use.

The invention claimed is:

1. An assembly comprised of a tank container, an inliner and a connection unit for the transport and/or storage of a fluid, wherein (a) the tank container:

(a1) is of a cylindrical-like shape and comprises a first end portion, a second end portion and a longitudinal axis extending from the first end portion to the second end portion;

(a2) comprises a circumferential wall having an inner surface inside the tank container and an outer surface outside the tank container, the circumferential wall being present between a first wall at the first end portion of the tank container and a second wall at the second end portion of the tank container, the first wall and the second wall having an inner surface inside the tank container and an outer surface outside the tank container;

(a3) comprises a drain hole that is present either in the first wall at the first end portion of the tank container thereby abutting the circumferential wall, or at the interface of the circumferential wall with the first wall at the first end portion of the tank container, the drain hole merging into a container spout extending from the first wall at the first end portion of the tank container or at the interface of the two walls, the container spout being provided with fastening means for connecting with the connection unit;

(a4) has an inner circumference around the circumferential wall;

(a5) has a bottom length, which is the length of the circumferential wall in the longitudinal direction, measured from a) that point on the interface of the circumferential wall with the first wall that comprises the drain hole to b) the corresponding point at the interface of the circumferential wall with the second wall; and (a6) has a first wall height that is defined as the distance from the drain hole to the opposite interface of the circumferential wall with the first wall at the first end portion of the tank container, measured along the inner surface of the first wall at the first end portion of the tank container; and (a7) comprises a manhole; and wherein (b) the inliner:

(b1) is present inside the tank container;

(b2) comprises at least two sheets lying on top of each other and that are sealed together at their edges, the inliner having:

a longitudinal dimension (length) between two short edges of the inliner, the longitudinal dimension being equal to the bottom length of the tank container plus 0.4-2.0 times the wall height of the first wall of the tank container plus 0.4-2.0 times the wall height of the second wall of the tank container, when measured over the surface of the inliner; and a transverse dimension (width) between two long edges of the inliner, the transverse dimension being perpendicular to the longitudinal dimension and being in the range of 0.4-1.0 times the inner circumference around the circumferential wall, when measured over the surface of the inliner, wherein the inner circumference is the largest circumference that is present between the first wall and the second wall, measured over the inner surface of the circumferential wall;

(b3) comprises an opening merging into an inliner spout, wherein the opening is positioned on or adjacent to a central line extending along the longitudinal dimension of the inliner, wherein the shortest distance between the inliner spout and one of the short edges of the inliner is in the range of 0.1-2.0 times the wall height of the first wall;

the inliner spout is extending through the drain hole of the tank container and through at least part of the container spout, wherein the inliner spout is attached to the container spout;

the inliner is oriented in the tank container in such way that the central line along the longitudinal dimension comprising the inliner spout is aligned with the bottom length of the tank container, wherein the short edge of the inliner that is closest to the inliner spout is positioned at the first end portion of the tank container; and wherein (c) the connection unit:

(c1) comprises a tube for the passage of a liquid, the tube having a first end portion that extends through the container spout and through the inliner spout such that the first end portion of the connection unit extends into the tank container and into the inliner, and a second end portion that is outside the container spout, outside the inliner spout and outside the container, the second end portion comprising a closing means to control the passage of liquid through the tube;

(c2) comprises fastening means for connecting to the container spout; and (c3) is fastened to the container spout; wherein the first end portion of the tube is pressed against the inside of the inliner spout so that there is a liquid tight and air tight connection of the inliner spout with the connection unit.

2. The assembly according to claim 1, wherein the tank container has the shape of a cylinder, and wherein the length of the tank container is in a range of 1-10 times a diameter of the tank container.

3. The assembly according to claim 1, wherein the inliner comprises a stopper capable of closing the inliner spout when the connection unit is not fastened to the container spout and the first end portion of the tube is not pressed against the inside of the inliner spout.

4. The assembly according to claim 1, wherein the first end portion of the connection unit and/or the inliner spout is of a conical shape.

5. The assembly according to claim 1, wherein the first end portion of the connection unit extends through the inliner spout into the tank container and at least 4 cm into the inliner.

6. An inliner for use in the assembly of claim 1, wherein the inliner comprises at least two sheets lying on top of each other and having edges that are sealed together, wherein the inliner comprises:

a longitudinal dimension (length) between two short edges of the inliner;

a transverse dimension (width) between two long edges of the inliner, the transverse dimension being perpendicular to the longitudinal dimension;

an opening merging into an inliner spout, wherein the opening is positioned on or adjacent to a central line extending along the longitudinal dimension of the inliner, wherein the inliner spout is provided with a stopper that closes the inliner spout, wherein the stopper is capable of being released into the inliner when the inliner is positioned in the assembly.

7. The inliner according to claim 6, wherein the inliner is folded according to a folding pattern wherein:

(i) a first folding structure comprising two folding lines is present wherein the first long edge and the second long edge of the inliner are each folded over the central line and at the side of the inliner that is opposite to the side containing the inliner spout, so that a first folding line and a second folding line are present substantially parallel to the central line, each folding line occurring at a distance from the central line that is between 0.17 and 0.25 times the length of the short edge, and each folding line acting as a new long edge of the inliner having the first folding structure;

(ii) a second folding structure comprising two folding lines is present wherein the first folding line and the second folding line of the inliner having the first folding structure are each folded without passing the central line and at the side of the inliner that is opposite to the side containing the inliner spout, so that a third folding line and a fourth folding line are present substantially parallel to the central line, wherein the third folding line is present between the second long edge and the first folding line and the fourth folding line is present between the first long edge and the second folding line;

(iii) a third folding structure comprising two folding lines is present wherein the first short edge and the second short edge of the inliner having the first and second folding structure are folded towards each other and at the side of the inliner that is opposite to the side containing the inliner spout, so that a fifth folding line and a sixth folding line are present substantially perpendicular to the central line, wherein the fifth folding line abuts the inliner spout or is at a distance from the inliner spout of less than one fifth of the smallest distance between the inliner spout and the first short edge and wherein the sixth folding line is closer to the second short edge than to the inliner spout; and (iv) optionally, the inliner having the first, second and third folding structure is rolled up from the sixth folding line towards the inliner spout in that the rolled-up portion is at the side of the inliner that is opposite to the side containing the inliner spout.

8. The inliner according to claim 6, wherein the longitudinal dimension is in a range of 8-10 meters and the transverse dimension is in a range of 4-6 meters.

9. The inliner according to claim 6, wherein a ratio of the longitudinal dimension to the transverse dimension is in a range of 1-5.

10. The inliner according to claim 6, further comprising a handle which is present on a side of the inliner that is opposite to a side comprising the inliner spout, the handle being a strip having a first end that is connected to the inliner at the short edge that is most remote from the spout, or that is connected to the inliner at a distance from that short edge of less than one tenth of the longitudinal dimension (length), the strip having a second end at a distance from the first end, the distance being at least 0.75 times the longitudinal dimension of the inliner, measured over the inliner.

11. A method for folding the liner according to claim 6, comprising:

(i) folding the first long edge of the inliner over the central line so that it passes that line and at the side of the inliner that is opposite to the side containing the inliner spout, so that a first folding line is formed substantially parallel to the central line, the first folding line occurring at a distance from the central line that is between 0.17 and 0.25 times the length of the short edge, the first folding line acting as a new long edge of the inliner; thereafter (ii) folding the second long edge of the inliner over the central line so that it passes that line and at the side of the inliner that is opposite to the side containing the inliner spout, so that a second folding line is formed substantially parallel to the central line, the second folding line occurring at a distance from the central line that is between 0.17 and 0.20 times the length of the short edge, the second folding line acting as a new long edge of the inliner; thereafter (iii) folding the first folding line of the inliner without passing the central line and at the side of the inliner that is opposite to the side containing the inliner spout, so that a third folding line is formed substantially parallel to the central line, wherein the third folding line is present between the second long edge and the first folding line; thereafter (iv) folding the second folding line of the inliner without passing the central line and at the side of the inliner that is opposite to the side containing the inliner spout, so that a fourth folding line is formed substantially parallel to the central line, wherein the fourth folding line is present between the first long edge and the second folding line; thereafter (v) folding the first short edge towards the second short edge of the inliner and at the side of the inliner that is opposite to the side containing the inliner spout, so that a fifth folding line is formed substantially perpendicular to the central line, wherein the fifth folding line abuts the inliner spout or is at a distance from the inliner spout of less than one fifth of the smallest distance between the inliner spout and the first short edge; thereafter (vi) folding the second short edge towards the first short edge of the inliner and at the side of the inliner that is opposite to the side containing the inliner spout, so that a sixth folding line is formed substantially perpendicular to the central line, wherein the sixth folding line is closer to the second short edge than to the inliner spout; and thereafter (vii) optionally rolling up the inliner from the sixth folding line towards the inliner spout, wherein the rolled-up portion is at the side of the inliner that is opposite to the side containing the inliner spout.

12. A method for preparing the assembly according to claim 1, comprising:

(I) providing a tank container;

(II) providing an inliner, wherein (1) a longitudinal dimension of the inliner is equal to the bottom length of the tank container plus 0.4-2.0 times the wall height of the first wall of the tank container plus 0.4-2.0 times the wall height of the second wall of the tank container, when measured over the surface of the inliner;

(2) a transverse dimension of the inliner is in a range of 0.4-1.0 times an inner circumference around the circumferential wall, when measured over a surface of the inliner, wherein the inner circumference is the largest circumference that is present between the first wall and the second wall, measured over the inner surface of the circumferential wall;

(3) a shortest distance between the inliner spout and one of the short edges of the inliner is in a range of 0.1-2.0 times the height of the first wall of the tank container; and (4) the inliner spout is provided with a stopper that closes the inliner spout, wherein the stopper is capable of being released into the inliner when the stopper is pushed on from the outside of the inliner;

(III) providing a connection unit;

(IV) bringing the inliner into the inside of the tank container by passing it through the manhole;

(V) pressing the inliner spout into the container spout and aligning the inliner with the tank container so that the central line of the inliner is substantially in the direction of the bottom length;

(VI) pushing the first end portion of the tube of the connection unit into the container spout and the inliner spout from the outside of the tank container, to thereby push the stopper backwards into the inliner so that it releases from the inliner spout; and (VII) fastening the connection unit to the container spout by connecting fastening elements together.

13. The method according to claim 12, wherein after pushing the first end portion into the container spout and the inliner spout, the first end portion protrudes into the tank container and into the inliner.

14. The method according to claim 13, wherein the first end portion protrudes at least 4 cm into the inliner.

* * * * *